United States Patent [19]

Abe

[11] Patent Number: 4,920,851

[45] Date of Patent: May 1, 1990

[54] AUTOMATIC MUSICAL TONE GENERATING APPARATUS FOR GENERATING MUSICAL TONES WITH SLUR EFFECT

[75] Inventor: Yasunao Abe, Hamamatsu, Japan

[73] Assignee: Yamaha Corporation, Hamamatsu, Japan

[21] Appl. No.: 196,974

[22] Filed: May 20, 1988

[30] Foreign Application Priority Data

May 22, 1987 [JP] Japan ..... 62-126750

[51] Int. Cl.[5] ..... G10H 7/00; G10H 1/02; G10H 1/06

[52] U.S. Cl. ..... 84/626; 84/601; 84/622; 84/627; 84/628; 84/629

[58] Field of Search ..... 84/DIG. 12, 1.25, 1.24, 84/1.03, 622, 624–627, 629, 662, 663, 634, 701, 702, 706, 606, 609, 610, 628

[56] References Cited

U.S. PATENT DOCUMENTS

| | | | |
|---|---|---|---|
| 3,929,053 | 12/1975 | Deutsch | 84/1.24 |
| 4,122,743 | 10/1978 | Tomisawa et al. | 84/1.24 |
| 4,347,772 | 9/1982 | Nishimoto | 84/1.24 X |
| 4,524,668 | 6/1985 | Tomisawa et al. | 84/1.24 |
| 4,558,624 | 12/1985 | Tomisawa et al. | 84/626 |
| 4,649,783 | 3/1987 | Strong et al. | 84/606 |
| 4,708,046 | 11/1987 | Kozuki et al. | 84/610 |
| 4,726,276 | 2/1988 | Katoh et al. | 84/1.24 X |

FOREIGN PATENT DOCUMENTS

| | | | |
|---|---|---|---|
| 54-107722 | 8/1979 | Japan | 84/1.24 |
| 54-107723 | 8/1979 | Japan | 84/1.24 |
| 58-211787 | 12/1983 | Japan . | |

*Primary Examiner*—A. T. Grimley
*Assistant Examiner*—Matthew S. Smith
*Attorney, Agent, or Firm*—Spensley Horn Jubas & Lubitz

[57] ABSTRACT

The automatic musical tone generating apparatus for generating musical tones with slur effect includes a pitch information storing device, a read-out device for reading out pitch information at a predetermined tempo from the pitch information storing device, a tone signal generating device for producing tone signals having pitches corresponding to the pitch information read out by the read-out device, a slur information storing device, a slur effect impartment detecting device for detecting, on the basis of the slur information stored in the slur information storing device, whether or not the slur effect is to be imparted to the musical tones corresponding to the read out pitch information, and a pitch information altering device for altering, when the slur effect impartment is detected, the read out pitch information to a pitch information gradually approaching to the pitch of the musical tone to be produced next and outputting the altered pitch information to the tone signal generating device. The automatic musical tone generating apparatus for generating musical tones with slur effect allows a performer to realize the slur effect with no unnaturality by simple performance technique.

7 Claims, 6 Drawing Sheets

AUTOMATIC MUSICAL TONE GENERATING APPARATUS FOR GENERATING MUSICAL TONES WITH SLUR EFFECT

BACKGROUND OF THE INVENTION

1. Field of the invention:

The present invention relates to an automatic musical tone generating apparatus for successively reading out at a predetermined tempo plural sets of pitch information preliminarily stored and automatically generating musical tones on the basis of the read-out pitch information, and more specifically to an automatic musical tone generating apparatus so improved as to impart the slur effect (slide effect) of smooth shift from a certain pitch to a next pitch to the generated tones.

2. Description of the prior art:

As the prior art, Japanese Patent Laid-open No. Sho 58-211787 disclosed an electronic musical instrument which is capable of realizing the so-called slur effect, slide effect and portamento effect, when a new key is depressed on the keyboard, by converting pitch information representing the key depressed immediately previously into pitch information gradually shifting toward the pitch information representing the key newly depressed, and outputting the converted pitch information to the tone generating circuit so as to obtain a musical tone of a pitch smoothly shifting from the key depressed immediately previously toward the key newly depressed.

However, in case of the above-mentioned conventional musical apparatus wherein pitch is shifted, after a new key is depressed, from the pitch of the musical tone whose generation has already been finished to the pitch corresponding to the key newly depressed, the effect is different from the slur effect in its original sense which should shift pitch smoothly toward the future and the generated musical tones are unnatural. Therefore, the performer of the above-mentioned electronic musical instrument must efface the unnaturality by depressing, when a note with the slur sign appears on a score, the key corresponding to the note earlier by one note length than the timing specified for the note on the score. However, such performance is possible only for extremely skilled persons and the conventional musical apparatus poses a problem that it cannot be operated well by ordinary persons. For this reason, it has hitherto been desired to obtain a musical apparatus which can provide the natural slur effect in a simple procedure.

SUMMARY OF THE INVENTION

A primary object of the present invention is to provide an automatic musical tone generating apparatus so adapted as to be capable of producing the slur effect free from unnaturality in simple procedures.

Another object of the present invention is to provide an automatic musical tone generating apparatus allowing unskilled persons to enjoy performance with the natural slur effect in uncomplicated playing technique.

The automatic musical tone generating apparatus comprises a pitch information storing means for storing plural sets of pitch information representing pitches of musical tones to be generated automatically, a read-out means for successively reading out at a predetermined tempo said pitch information stored in the pitch information storing means, a tone generating means for receiving the pitch information read out by the read-out means and generating musical tones having the pitches corresponding to said pitch information, a slur information storing means for corresponding the slur information representing whether or not the slur effect is imparted to the musical tones to be generated to a set of the pitch information stored in the pitch information storing means and storing said slur information, a slur effect impartment detecting means for detecting whether or not the slur effect is imparted to the musical tone corresponding to the pitch information read out by the read-out means on the basis of the slur information stored in the slur information storing means, and a pitch information altering means for altering, when impartment of the slur effect is detected by the slur effect impartment detecting means, the pitch information read out by the read-out means into pitch information gradually approaching with time lapse to the pitch of the musical tone to be generated next and outputting the latter pitch information to the tone generating means.

Accordingly, in the automatic musical tone generating apparatus according to the present invention wherein the pitch information stored in the pitch information storing means is read out successively at a predetermined tempo by the read-out means and supplied to the tone generating means, and the tone generating means generating the musical tones having the pitches corresponding to said pitch information, musical tones are generated automatically at the predetermined tempo from the tone generating means. When the slur effect impartment detecting means detects, in the process described above and on the basis of the slur information stored in the slur information storing means, that the slur effect is to be imparted to the musical tones corresponding to the pitch information read out by the read-out means and supplied to the tone generating means, the pitch information altering means alters the read-out information into pitch information gradually approaching with time lapse to the pitch of the musical tone to be generated next and outputs the latter pitch information to the tone generating means, whereby the tone generating means generates a musical tone gradually shifting from the pitch corresponding to the pitch information read out by the read-out means to the pitch of the tone to be generated next by the tone generating means.

Since the pitch of musical tone generated by the tone generating means shifts not from the pitch of a musical tone having already been generated but from the pitch of a musical tone to be generated immediately, the automatic musical tone generating apparatus according to the present invention provides the slur effect free from unnaturality. Further, since the slur effect is realized in an automatic musical tone generating apparatus which automatically controls generation of musical tones in the case of the present invention, no complicated technique is required to obtain the slur effect and even unskilled persons can enjoy performance with the slur effect free from unnaturality.

These and other objects as well as the features and the advantages of the present invention will become apparent from the following detailed description of the preferred embodiments when taken in conjunction with the accompanying drawings.

DESCRIPTION OF THE PREFERRED EMBODIMENTS

Figure 1:
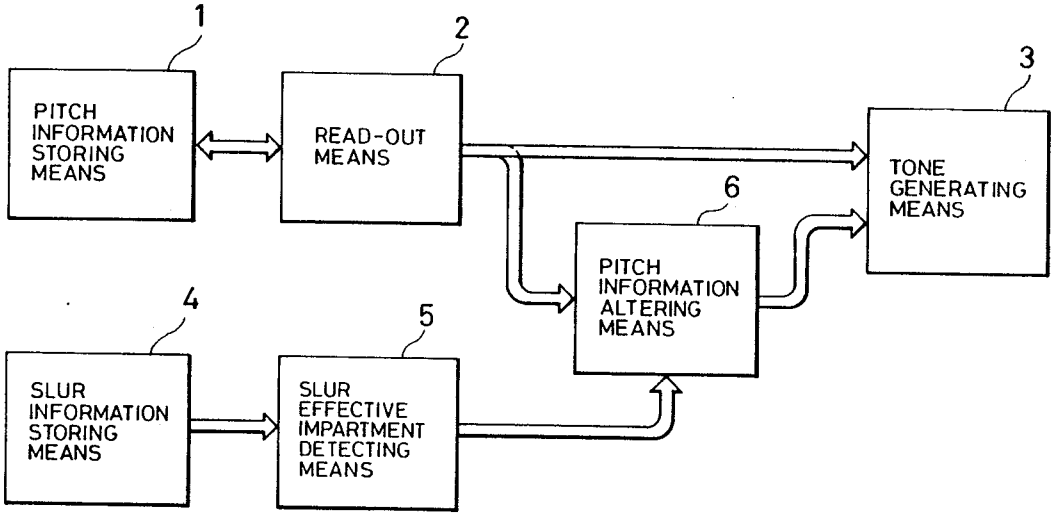
FIG. 1 is a block diagram illustrating an embodiment of the automatic musical tone generating apparatus for generating musical tones with slur effect according to the present invention.

First, the principles of the formation and functions of the automatic musical tone generating apparatus will be described. The characteristic of the formation of the automatic musical tone generating apparatus according to the present invention is seen from FIG. 1. Speaking concretely, in an automatic musical tone generating apparatus comprising a pitch information storing means 1 for storing plural sets of pitch information representing pitches (frequencies) of the musical tones to be automatically generated, a read-out means 2 for successively reading out at a predetermined tempo the pitch information stored in the pitch information storing means 1, and a tone generating means 3 for receiving the pitch information read out by the read-out means 2 and generating musical tones having the pitches corresponding to said pitch information, there are arranged a slur information storing means 4 for storing slur information representing whether or not the slur effect is imparted to the musical tones to be generated in correspondence to the plural sets of pitch information stored in the pitch information storing means 1, a slur effect impartment detecting means 5 for detecting, on the basis of the slur information stored in the slur information storing means 4, whether or not the slur effect is imparted to the musical tone corresponding to the pitch information read out by the read-out means 2, and a pitch information altering means 6 for altering, when impartment of the slur effect is detected by the slur effect impartment detecting means 5, the pitch information read out by the read-out means 2 into pitch information gradually approaching with time lapse to the pitch of the musical tone to be generated next.

The "slur effect" shall herein mean an effect which shifts a certain tone gradually or smoothly to another pitch, and include the so-called slur effect, slide effect, portamento effect and glissando effect. Since the pitch information stored in the pitch information storing means 1 is read out at a predetermined tempo by the read-out means 2 and supplied to the tone generating means 3 and the tone generating means 3 generates the musical tones having the pitches corresponding to the pitch information in the automatic musical tone generating apparatus according to the present invention, musical tones are generated automatically at the predetermined tempo from the musical tone generating means 3. When, in this process, the slur effect impartment means 5 detects, on the basis of the slur information stored in the slur information storing means 4, that the slur effect is to be imparted to the musical tone corresponding to the pitch information read out by the read-out means 2 and supplied to the tone generating means 3, the pitch information altering means 6 alters the read-out pitch information into a pitch information gradually approaching with time lapse to the musical tone to be generated next and outputs the latter pitch information to the tone generating means 3, whereby the tone generating means 3 generates a musical tone having pitch shifting from the pitch corresponding to the pitch information read out by the read-out means 2 gradually to the pitch of the musical tone to be generated next by the tone generating means 3.

Figure 2:
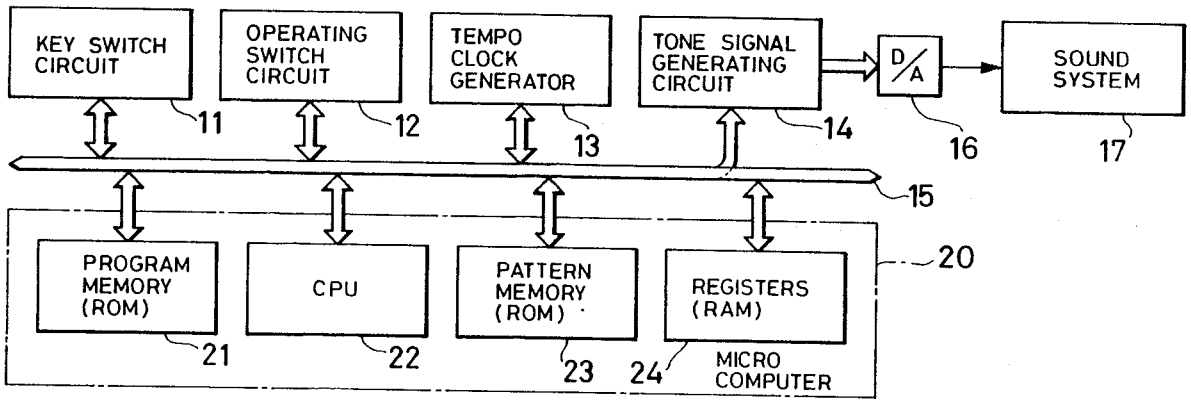
FIG. 2 is a block diagram illustrating an example of an electronic musical instrument to which the present invention is applied.

FIG. 2 shows an electronic musical instrument equipped with an automatic accompanying device to which the present invention is applied. This electronic musical instrument comprises a key switch circuit 11, an operating switch circuit 12, a tempo clock generator 13, a tone signal generating circuit 14 and a microcomputer 20 connected to each of said circuits by way of a busline 15.

The key switch circuit 11 consists of a plural number of key switches corresponding to the keys arranged on a keyboard (not shown) and each of the key switches is opened and closed by operation of each key. The operating switch circuit 12 consists of a plural number of operating switches corresponding to a plural number of operating members (not shown) for controlling rhythm start, etc., and each of the operating switches is opened and closed by operation of each operating member. The tempo clock generator 13 determines tempo of rhythm and outputs tempo clock signals having predetermined frequencies in correspondence to operations of tempo adjustment operating members (not shown). The tone signal generating circuit 14 has a plural number of tone signal generating channels, each of which generates, on the basis of the key data supplied thereto, digital tone signals having a frequency corresponding to key data KD. The output of the tone signal generating circuit 14 is supplied to a sound system 17 through a converter 16. The sound system 17 consists of an amplifier and a loudspeaker, and produces a musical tone corresponding to the supplied analog tone signal.

Figure 3:
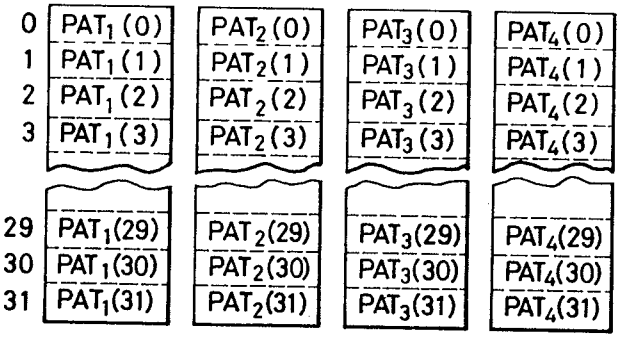
FIG. 3 is a memory map of the pattern memory shown in FIG. 2.

The microcomputer 20 consists of a program memory 21, a CPU 22, a pattern memory 23 and a group of registers 24. The program memory 21 consists of a ROM which stores a main program corresponding to the flow chart shown, in FIG. 5 and clock interrupt programs corresponding to the flow charts shown in FIGS. 6A and 6B. The CPU 22 is adopted for executing the programs mentioned above. When the power switch (not shown) is turned on, the CPU 22 executes the main program or, each time a tempo clock signal reaches from the tempo clock generator 13, it suspends the execution of the main program and executes the clock interrupt program which is causing interrupt of the main program. The pattern memory 23 consists of a ROM which stores accompaniment data representing the accompanying tones to be generated on the basis of chords performed on the keyboard for each type of rhythm and taking C-major as standard. Each set of the accompaniment data consists, as shown in FIG. 3, of pattern data $PAT_1$ to $PAT_4$ for four channels, and pattern data $PAT_i$ (i=1 to 4) consists of 32 pattern data $PAT_i(0)$ to $PAT_i(31)$ which are prepared by dividing one bar into 32 equal fractions and arranging them sequentially in accordance with time lapse. In this case, each pattern data $PAT_i(j)$ (j=0 to 31) consists of slur data SL of one bit representing whether or not the slur effect is to be imparted and a key code KC of 7 bits representing a pitch of each key, and has a format shown in FIG. 4A wherein the slur data SL is allocated to the highest bit and the key code KC is assigned to the lower bits. In addition, slur data "1" represents the slur effect impartment and slur data "0" designates no slur effect impartment. The slur data SL represents whether or not the slur effect is to be imparted to the note corresponding to the pattern data $PAT_i(j-1)$ one address before each pattern data $PAT_i(j)$. The pattern data $PAT_i(j)$ indicates end of the tone signal generation (key off) by "00" in the hexadecimal notation, and data having no relation to generation start or end of tone signal (no operation) by "FF" in the hexadecimal notation.

The register group 24 consists of RAMs, and temporarily stores the following data required for execution of the main program and other types of data.

Rhythm running RUN . . . . "1" indicates rhythm operation busy and "0" represents rhythm operation stop.

Tempo clock signal CLK . . . . Count (0 to 95) of the tempo clock signals from the tempo clock generator indicates rhythm advance position.

Address data ADRS . . . . Address data (0 to 31) indicate the addresses corresponding to j of the pattern data $PAT_1(j)$ to $PAT_4(j)$ in the pattern memory 23.

Root data ROOT . . . . Root data represent roots of chords performed on the keyboard.

Type data TYPE . . . . Type data represent types of major tones, minor tones, chords, etc. performed on the keyboard.

Operation key code TKC . . . . This code indicates the key code KC of the program being processed in the microcomputer 20.

Start key codes $STKC_1$ to $STKC_4$ . . . . This data represents the key code KC at the start time of the slur effect in each channel.

Destination key codes $DSKC_1$ to $DSKC_4$ . . . . This data represents a key code KC to be used as a target of the slur effect impartment time in each channel.

Key code differences $\Delta KC_1$ to $\Delta KC_4$ . . . . This data represents a difference obtained by subtracting the start key code $STKC_1 \sim STKC_4$ from the destination key code $DSKC_1 \sim DSKC_4$ in each channel.

Offset key codes $OFKC_1$ to $OFKC_4$ . . . . This data represents key code differences $\Delta KC_1$ to $\Delta KC_4$ having inverted positive or negative sign.

Offset key data OFKD . . . . This data represents offset from the key data corresponding to the destination key code DSKC.

Output key data OTKD . . . . This data is supplied to the tone signal generating circuit to indicate pitch of the tone signal to be generated by said circuit Slur time data $STIM_1$ to $STIM_4$ . . . . This data indicates the time from a slur effect starting note to the next note in each channel as an address number on the time axis in the pattern memory 23.

Slur counts $SCNT_1$ to $SCNT_4$ . . . . This data indicates time lapse from slur start in each channel as a number of tempo clock signals.

Figure 4A:
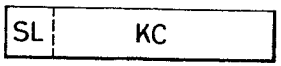
FIGS. 4A and 4B are drawings descriptive of formats of the data used in the electronic musical instrument shown in FIG. 2.
Figure 4B:
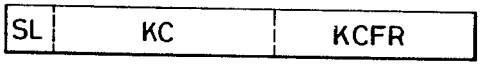

In addition, the operation key code TKC, start key codes $STKC_1$ to $STKC_4$, destination key codes $DSKC_1$ to $DSKC_4$, key code differences $\Delta KC_1$ to $\Delta KC_4$ and offset key codes $OFKC_1$ to $OFKC_4$ consist, like the pattern data $PAT_i(j)$, of slur data SL and key code KC, and has, like the pattern data $PAT_i(j)$, the data format shown in FIG. 4A. Further, the key data KC has, in addition to the key code KC, a fraction part KCFR representing a pitch prepared dividing a pitch between two neighboring keys. The offset key data OFKD and output key data OTKD have a format consisting of the slur data, key code KC and key code fraction part KCFR as shown in FIG. 4B.

Figure 5:
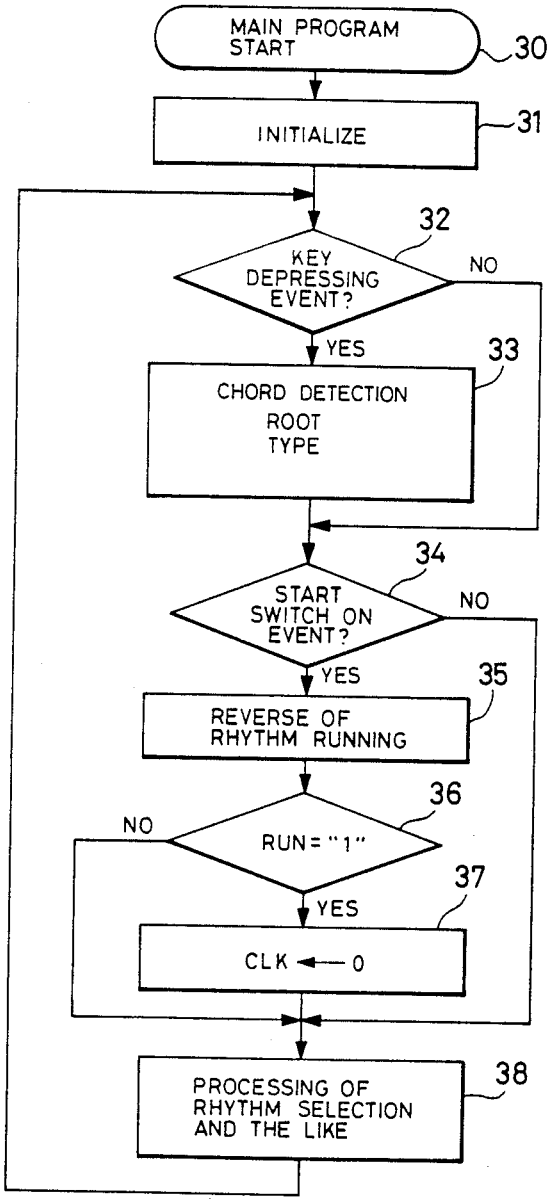
FIGS. 5, 6A and 6B are flow charts corresponding to an example of the programs to be executed by the microcomputer shown in FIG. 2.
Figure 6A:
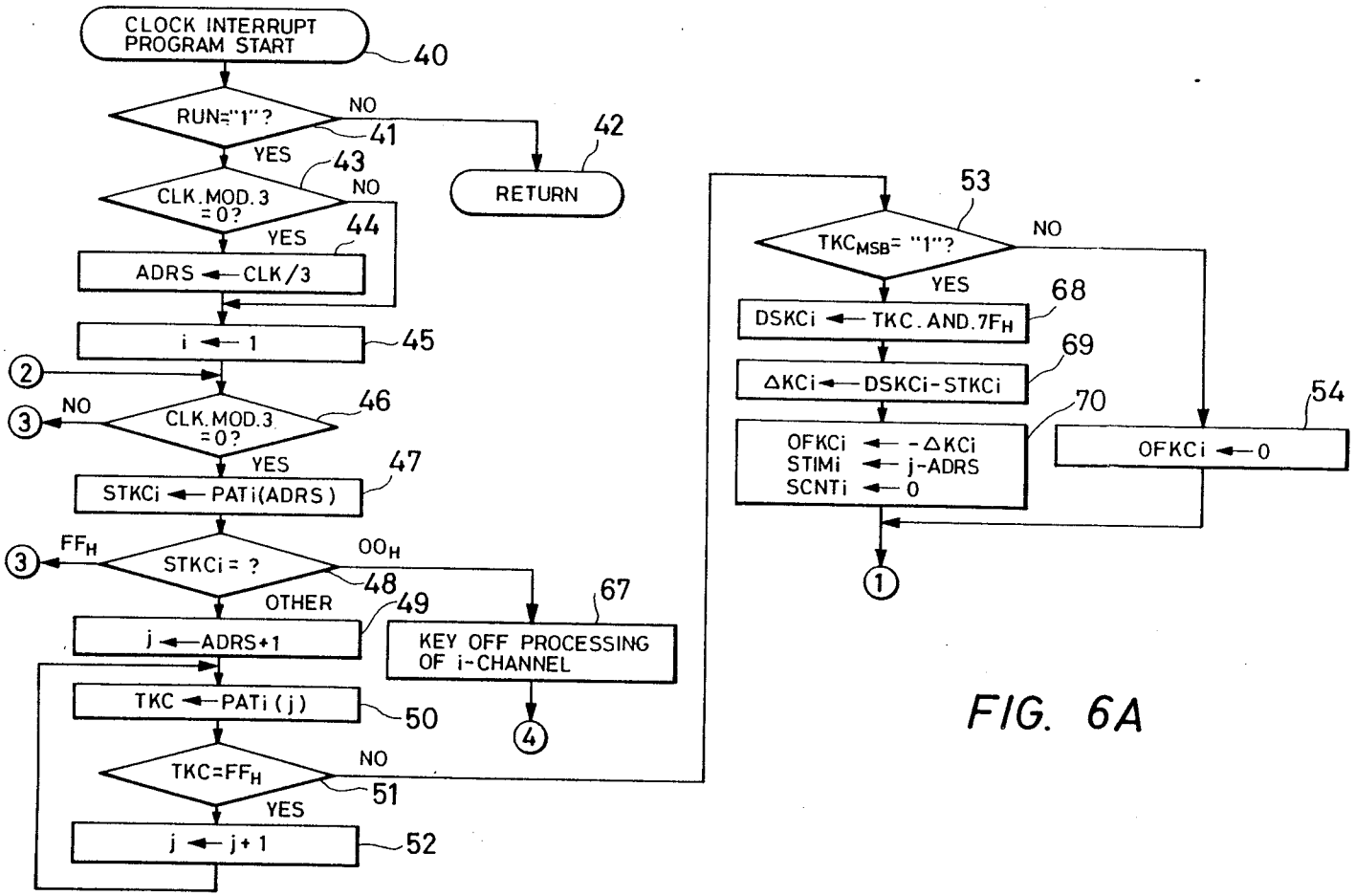
Figure 6B:
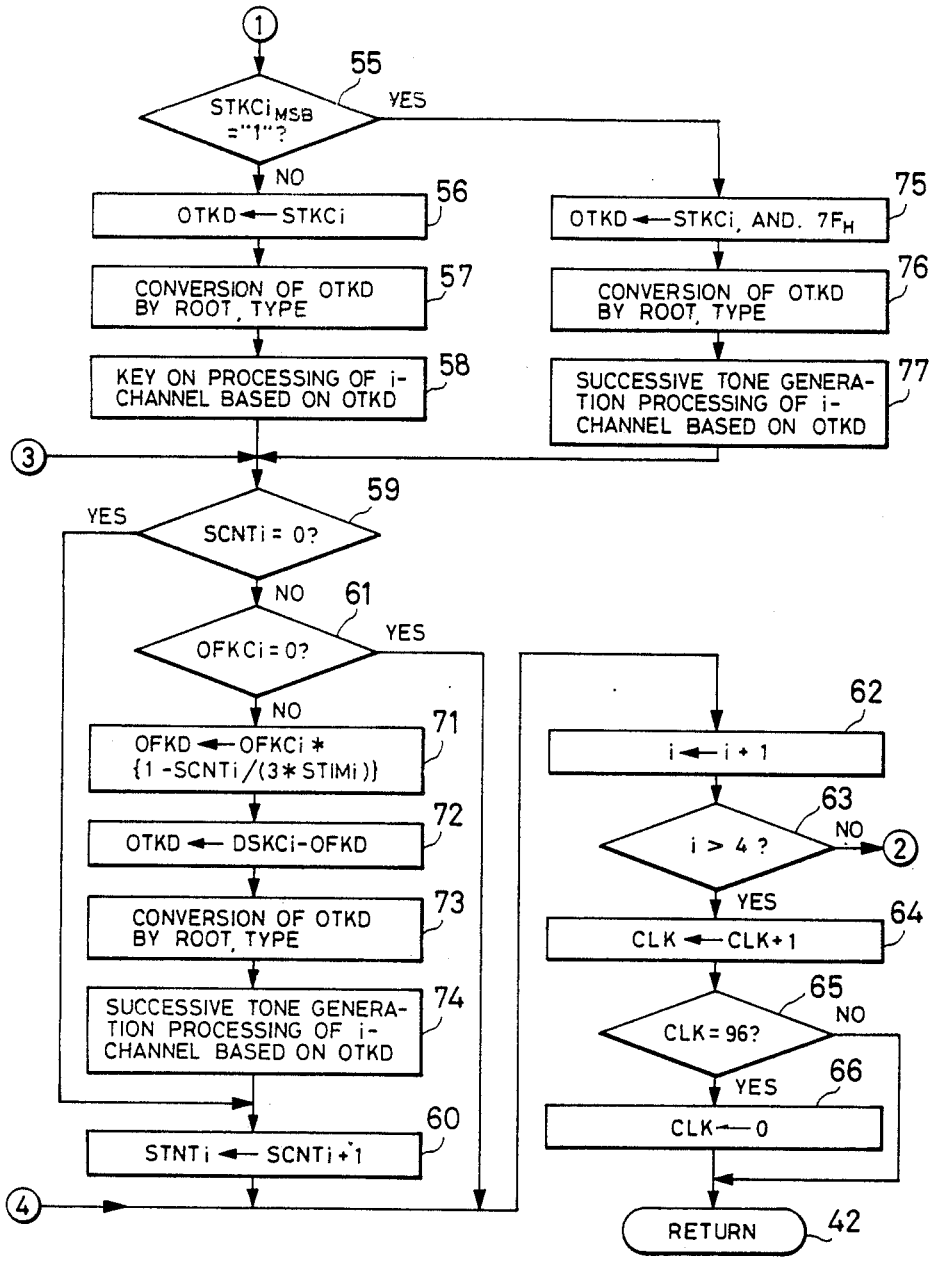

Functions of the embodiment having the above-described formation will be described with reference to the flow charts illustrated in FIGS. 5, 6A and 6B. When the power switch is turned on, the CPU 22 starts execution of the main program at step 30 and initializes the microcomputer 20 at step 31 by clearing the data stored in each register of the register group 24. After the initialization, the CPU 22 cooperates with the register group 24 at step 32 to detect key depressing event on the keyboard on the basis of key switch states in the key switch circuit 11. When a new key is depressed, "YES" meaning presence of the key depressing event is judged at step 32, and the CPU 22 detects the chord name assigned on the keyboard at step 33 on the basis of the data on the key currently depressed and allows the register group 24 to store the root and type of the detected chord as ROOT and TYPE. Accordingly, each time a new key is depressed on the keyboard, the ROOT and TYPE stored in the register group 24 are updated. If a new key is not depressed, in contrast, the CPU 22 judges "NO" at step 32 and allows the program to proceed to step 34. At step 34, the CPU 22 cooperates with the register group 24 to detect ON event of the rhythm start switch on the basis of the rhythm start switch arranged in the operating switch circuit. When the rhythm start switch is newly turned on, "YES" meaning presence of the ON event is judged at step 34, and the CPU 22 inverts the rhythm running RUN from previous "0" to "1" or previous "1" to "0" and judges whether or not the rhythm running RUN as the inversion result is "1" at step 36. When the new rhythm running RUN is "1", the CPU 22 judges "YES" at step 36, sets tempo clock signal CLK at "0" and allows the program to proceed to step 38. When the new rhythm running is "0", the CPU 22 judges "NO" at step 36, and allows the program to proceed to step 38 without executing program processing at step 37. If the rhythm start switch is not newly turned on, the CPU 22 judges "NO" at step 34 and allows the program to proceed to step 38. By the processings at steps 34 to 37 described above, the rhythm running RUN is inverted each time the rhythm start switch is turned on and, if the inversion result is "1", tempo clock signal CLK is set at "0". The setting of tempo clock signal CLK means that the rhythm advance position is set at the initial position at the rhythm performance start time. Then, the CPU 22 cooperates with the register group 24 to detect ON event of the rhythm selection switches and other switches, executes processing related to the switch whose ON event is detected, and modifies the rhythm selection and various types of control data for the other switches. After the processing at step 38, the CPU 22 returns the program to step 32 and then continues the processings related to the key switches and operating switches by executing the circulating processings consisting of steps 32 to 38.

When tempo clock signals are generated from the tempo clock generator 13 during the circulating processings described above, the CPU 22 stops execution of the above-mentioned main program and allows the clock interrupt program (illustrated in FIGS. 6A and 6B) to be executed. In this clock interrupt program, the CPU 22 starts execution of the program at step 40 and judges whether or not the rhythm running RUN is "1" at step 41. If the rhythm running RUN is set at "0" by the processings at steps 31 and 35, the CPU 22 judges "NO" i.e., that rhythm accompaniment is not performed, and proceeds to step 42, at which the CPU 22 terminates execution of the clock interrupt program and returns again to execution of the main program. If the rhythm running RUN is set at "1", the CPU 22 judges "YES" i.e., that rhythm accompaniment is being performed, and proceeds to step 43 and subsequent steps to control generation of accompanying tones. Functions at these steps when the slur effect is imparted to accompanying tones are different from those when the slur effect is not imparted to accompanying tones. Functions in each case will be described below.

(1) When the slur effect is not imparted to accompanying tones.

Figure 7A:
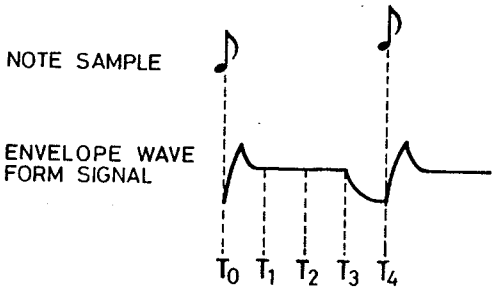
Figure 7B:
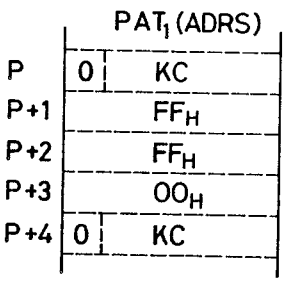

The functions to be carried out when the slur effect is not imparted to accompanying tones will be described taking as an example the case where the accompanying tones corresponding to the note example shown in FIG. 7A are to be generated in the channel No. 1. In this case, the pattern data $PAT_1(j)$ is as shown in FIG. 7B.

After the processing at step 41, the CPU 22 judges at step 43 whether or not the remainder obtained by dividing number of the tempo clock signals CLK by 3 is "0". This judgment processing is carried out to allow address ADRS to advance only when number of the tempo clock signals CLK is an integral times (P times) of 3 since number of the tempo clock signals CLK varies from "0" to "95", whereas address ADRS varies from "0" to "31". If number of the tempo clock signals CLK is 3P at time $T_0$ (FIG. 7A), the CPU 22 judges "YES" i.e., that the remainder is "0" at step 43 and sets the quotient P obtained by dividing the number of the tempo clock signals CLK (=3P) by "3" as address ADRS at step 44. After the processings at step 44, the CPU 22 sets variable i representing the accompanying tone channel No. at "1" at step 45, judges that the remainder obtained by dividing the number of the tempo clock signals CLK by "3" is "0" by the processing similar to that at step 43, and allows the program to proceed to step 47. At step 47, reference is made to the pattern memory 23 on the basis of type of rhythm, variable i (=1) and address ADRS (=P), the pattern data $PAT_1(P)$ shown in FIG. 7B is read out of the pattern memory 23, and said data $PAT_1(P)$ is set and stored as a start key code $STKC_1$. Then, the CPU 22 judges at step 48 whether the start key code $STKC_1$ is "00" (hexadecimal notation), "FF" (hexadecimal notation) or has a different value. Since the start key code $STKC_1$ is set at the pattern data $PAT_1(P)$ shown in FIG. 7B and not "00" or "FF" in this case, the CPU 22 advances the program to step 49 by the processing at step 48, and sets variable j corresponding to the address ADRS at P+1 by executing an operation of ADRS+1 at step 49. Then, the CPU 22 carries out the circulating processings consisting of steps 50 to 52 to increase the variable j one by one from P+1, set the pattern data $PAT_1(j)$ having addresses assigned by the increased variables j as operating key codes TKC, and sequentially search the operating key codes TKC having values other than "FF" (hexadecimal notation). In this case, since $PAT_1(j)$ is not "FF" when the variable j reaches P+3 as shown in FIG. 7B, the CPU 22 judges "NO" at step 51 on the basis of the operating key code TKC set at "00" (hexadecimal notation) by the processing at step 50, advances the program to step 53, and judges whether or not "1" is set in the highest bit of the operating key code TKC at step 53. Since the operating key code TKC is set at "00" as described above, "NO" is judged by the judgment processing at step 53, the offset key code $OFKC_1$ is set at 0 at step 54, and the program is advanced to step 55 (FIG. 6B).

At step 55, it is judged whether or not "1" is set in the highest bit MSB of the start key code $STKC_1$. In this case, since the start key code $STKC_1$ is the pattern data $PAT_1(P)$ shown in FIG. 7B and "0" is set in the highest bit MSB, the CPU 22 judges "NO" at step 55 and sets the output key data OTKC at start key code $STKC_1=PAT_1(P)$. In this case, the start key code $STKC_1$ is set in the higher 8 bits of the output key data OTKD as shown in FIG. 4B and "0" is set in all the lower bits of the output key data OTKD. Then, the CPU 22 converts the output key data OTKD according to the type of chord on the basis of ROOT and TYPE. Since the pattern data $PAT_1(j)$ stored in the pattern memory 23 is based on the C-major, a key code KC corresponding to the interval difference from the C-tone to the ROOT is added to the output data OTKD by the processing if the ROOT does not represent the C-tone, and the output key data OTKC is converted according to the pitch represented by the pattern data $PAT_1(j)$ if the TYPE is not on the major scale. For example, when the TYPE is on the major scale and the pattern data $PAT_1(j)$ is the E-tone (3-degree tone), the output key data OTKD is converted into key data half step lower. After the processing at step 57, the CPU 22 outputs the converted output key data OTKD together with the variable i (="1") through the bus 15 to the tone signal generating circuit 14 at step 58, supplies, to the tone signal generating circuit 14, control data to command start of generation of the tone signals by the tone signal generating circuit 14, i.e., to impart an attack to the tone signals. By receiving this data, the tone signal generating circuit 14 produces digital tone signals having the pitch corresponding to the output key data OTKD in channel No. i (="1") and outputs the signals with an envelope waveform rising from time $T_0$ shown in FIG. 7A. If the previous musical tone is not extinguished in this case, the generation of the tone signals is started after extinguishing the previous musical tone. The digital tone signals having the envelope waveform are supplied to the D/A converter 16 for conversion into analog tone signals and fed to the sound system 17. Since the sound system 17 produces a musical tone corresponding to said analog tone signals, the system 17 starts producing an accompanying tone related to the chord designated on the keyboard at the time $T_0$. After the processing at step 58, the CPU 22 judges whether or not the slur count $SCNT_1$ is "0" at step 59. In this case, since the slur effect is not imparted to the produced musical tone, this processing has no direct relation If the slur count $SCNT_1$ is "0", however, "YES" is judged at step 59 and the program proceeds to step 62 through the processing at step 60. If the slur count $SCNT_1$ is not "0", "NO" is judged at step 59, the CPU 22 judges "YES" at step 61 on the basis of the offset key code OFKC set by the processing at step 54 and advances the program to step 62.

At step 62, "1" is added to the variable i representing channel No. and the variable i is set at "2". Then, the CPU 22 judges whether or not the variable i is larger than "4" at step 63. In this case, since the variable i is "2", the CPU 22 judges "NO" at step 63, returns the program to step 46 (FIG. 6A) executes the above-described processings in the channel No. 2 and increase the variable i by "1" by repeating the processing at step 62. Subsequently, these processings are executed in the channels No. 2 and No. 4. When the variable i reaches "5", the CPU 22 judges "YES" i.e., that the variable i is larger than "4" at step 63 and adds "1" to the tempo clock signal CLK at step 64. In this case, the tempo clock signals CLK becomes 3P+1. Then, the CPU 22 judges whether or not the tempo clock signals CLK are equal to "96" at step 65. If the tempo clock signal is not equal to "96", the CPU 22 judges "NO" and terminate the execution of the interrupt program at step 42. When the tempo clock signals CLK are equal to "96", the CPU 22 judges "YES" at step 65, resets the tempo clock signal CLK at "0" at step 66 and terminates the execution of the program at step 42. By the processings at steps 64 to 66, the tempo clock signal CLK advances one by one within a range from "0" to "95" each time the clock interrupt program is executed.

On the other hand, when the tempo clock signal CLK is output again from the tempo clock generator 13 during execution of the main program, the CPU 22 starts execution of the clock interrupt program again at step 40, judges "YES" on the basis of rhythm running RUN="1" at step 41 and judges whether or not the remainder obtained by dividing number of the tempo clock signals CLK by "3" is "0" at step 43. In this case, since the number of the tempo clock signals CLK is 3P+1 as described above, the CPU 22 judges "NO" at step 43, sets the variable i at "1" at step 45, judges "NO" at step 46 similarly to step 43 and advances the program to step 59. After the processings at steps 59 to 61, the CPU 22 modifies the variable i to "2" at step 62, returns the program to step 46 and subsequently executes the circulating processing consisting of steps 46 and 59 to 63 until the variable i reaches "5". When the variable i reaches "5", the CPU 22 judges "YES" at step 63 similarly to the case described above, increases the tempo clock signals CLK by "1" by the processings at steps 64 to 66 and terminates the execution of the clock interrupt program at step 42. The tempo clock signals CLK are set at 3P+2. Accordingly, the tone signals produced by the tone signal generating circuit 14 are not modified or controlled in any way.

When the tempo clock generator 13 produces tempo clock signals CLK once again, the clock interrupt program is executed once again. However, since number of the tempo clock signals CLK is 3P+2 and the remainder obtained by dividing the number of the tempo clock signals CLK by "3" is not "0" similarly to the case described above, execution of the program brings a result of 3P+3 only. When the clock interrupt program is executed by outputting tempo clock signals from the tempo clock generator 13 in this condition where the remainder obtained by dividing the number of tempo clock signals CLK (3P+3) by "3" is "0", the CPU 22 judges "YES" at step 43 and sets address ADRS at P+1 determined as the quotient obtained by dividing the number of the tempo clock signals CLK by "3" at step 44. Then, the CPU sets the variable i at "1" at step 45, judges "YES" at step 46 similarly to step 43, and sets the start key code $STKC_1$ at the pattern data $PAT_1(P+1)$ having the address of P+1 shown in FIG. 7B at step 47. After the processing at step 47, the CPU 22 judges whether the start key code $STKC_1$ set at step 48 is "00" (hexadecimal notation), "FF" (hexadecimal notation) or has a different value. In this case, since the pattern data $PAT_1(P+1)$ is "FF", the CPU 22 advances the program to step 59 by the judgment processing at step 48, increases the variable i to "5" by the subsequent processings similar to those described above, and then terminates the execution of the clock interrupt program by setting the tempo clock signals CLK at 3P+4. As a result, the tone signals produced by the tone signal generating circuit 14 are not modified or controlled in any way also in this case.

When tempo clock signals are produced from the tempo clock generator and the clock interrupt program is executed during the above-described processing with the tempo clock signals CLK set at 3P+9 and the pattern data $PAT_1(P+3)$ is "00" (hexadecimal notation) stored at addressed P+3 as shown in FIG. 7B. Therefore, the start key code $STKC_1$ read out of the pattern memory 23 on the basis of the address ADRS (=P+3) set by the processing at step 44 and set at step 47 becomes "00", and the CPU 22 advances the program to step 67 by the judgment processing at step 48. At step 67, control data for stopping production of the tone signal is output together with variable i (="1") representing a channel No. to the tone signal generating circuit 14. Accordingly, the tone signal generating circuit 14 adds an envelope waveform signal gradually attenuating at time $T_3$ as shown in FIG. 7A to the digital tone signals to be output and then stops generation of the tone signals, whereby musical tone produced from the sound system is gradually attenuated and extinguished. After the processing at step 67, the CPU 22 advances the program to step 62 and subsequently executes the above-described processings once again. Further, when time elapses until the tempo clock signals reach 3P+1, address ADRS becomes P+4. Since the pattern data $PAT_1(P+4)$ which is not "00" (hexadecimal notation) or "FF" (hexadecimal notation) is stored at the address ADRS (=P+4) as shown in FIG. 7B, generation of the musical tone corresponding to the pattern data $PAT_1(P+4)$ is controlled also at time $T_4$ similarly to the case at the above-mentioned time $T_0$ (see FIG. 7A). The musical tones corresponding to the note example without the slur effect impartment as shown in FIG. 7A are obtained in this way.

(2) When the slur effect is imparted to accompanying tones.

Figure 8A:
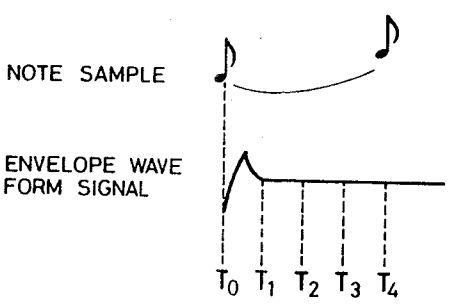
FIGS. 7A and 8A are diagrams illustrating note rows and signal waveforms descriptive of the functions of the electronic musical instrument shown in FIG. 2.

Functions for slur effect impartment will be described taking as an example the case where the accompanying tones corresponding to the note example shown in FIG. 8A are to be produced in the channel No. 1. In this case, the pattern data $PAT_1(j)$ corresponding to the note example are shown in FIG. 8A. Also, in this case, if tempo clock signals CLK are 3P at time $T_0$ (FIG. 8A), the CPU 22 sets the start code $STKC_1$ at pattern data $PAT_1(P)$ at step 47 after the processings at steps 41 and 43 to 46, and sets the operation key code TKC at pattern data $PAT_1(P+4)$ by searching the next pattern data $PAT_1(j)$ which is not "FF" (hexadecimal notation) by the processings at steps 49 to 52 after the processing at step 48 (see FIG. 8B). Since "1" is set as the pattern data $PAT_1(P+4)$ i.e., in the highest bit of the operating key code TKC in this case, the CPU 22 judges "YES" by the judgment processing at step 53 and advances the program to steps 68 to 70. At step 68, the operation key code TKC is converted by a logical product operation with "7F" (hexadecimal notation) into a destination key code $DSKC_1$ having the masked highest bit MSB, a key code difference $\Delta KC_1$ is calculated by subtracting the start key code $STKC_1$ from the destination key code $DSKC_1$ at step 69 and an offset key code $OFKC_1$ is determined by inverting the positive or negative sign of the key code difference $\Delta KC_1$ at step 70. Further, at step 70, a slur time $STIM_1$ is calculated by subtracting the address ADRS at which the start key code $STKC_1$ is stored from the variable j representing the address ADRS (=P+4) from which the operating key code TKC is searched out, and the slur count $SCNT_1$ is set at "0". After the processing at step 70 described above, the CPU 22 controls generation start of musical tones at time $T_0$ (FIG. 8A) by the processings at steps 55 to 58, similarly to the case described above, on the basis of "0" set in the highest bit MSB of the start key code $STKC_1$. Then, the CPU 22 judges whether or not the slur count $SCNT_1$ is "0" at step 59. In this case, since the slur count $SCNT_1$ is set at "0" by the processing at step 70, the CPU 22 judged "YES" at step 59, modifies the slur count $SCNT_1$ into "1" by adding "1" to the slur count $SCNT_1$ at step 60, and allows the program to proceed to step 60 and later steps. At steps 62 and later, processings related to the channels Nos. 2 to 4 are executed similarly to case where the slur effect is not imparted, number of the tempo clock signals CLK is set at 3P+1 by the processings at steps 64 to 66, and execution of the clock interrupt program is terminated. When the clock interrupt program is executed by generation of the tempo clock signals from the tempo clock generator in the condition described above, the CPU 22 executes the processings at steps 41 and 43 to 45, judges "NO", i.e., that the remainder obtained by dividing the tempo clock signals 3P+1 by "3" is not "0" similarly to the case where the slur effect is not imparted, and advances the program to step 59. In this case, since the slur count $SCNT_1$ is set at "1" by the processing at step 60 and the offset key code $OFKC_1$ is set a value other than "0" corresponding to the difference between the start key code $STKC_1$ and the destination key code $DSKC_1$ by the processing at step 70, the CPU 22 judges "NO" at each of steps 59 and 61, and advances the program to steps 71 and 72. At step 71, offset key data OFKD is calculated by executing the following calculation:

$$OFKD = OFKC_i * \{1 - SCNT_i/(3*STIM_i)\}$$

In this case, since the slur time $STIM_i$ corresponds to an address in the pattern memory 23, the slur count $SCNT_i$ corresponds to the tempo clock signals CLK and three tempo clock signals CLK correspond to said address, a ratio of time lapse from the start of the musical tone imparted with the slur effect relative to the slur time is calculated by $SCNT_i/(3*STIM_i)$ in the above formula and offset key data OFKD as an offset value at the present time from the destination key code $DSKC_1$ is calculated by subtracting the ratio from "1" and multiplying the offset key code $OFKC_1$ by the difference. In this case, the offset key data OFKD has a fraction part KCFR as shown in FIG. 4B. At step 72, output key data OTKD representing pitch to be produced at the present time is calculated by subtracting the offset key data OFKD from the destination key code $DSKC_1$. After the processing at step 72, the CPU 22 converts the key code part KC of the output key data OTKD (see FIG. 4B) according to type of chord on the basis of ROOT and TYPE by the processing at step 73 similar to that at step 57, outputs the converted output data OTKD together with the variable i (="1") through the bus 15 to the tone signal generating circuit 14 at step 74, and provides the tone signal generating circuit 14 with the control data to command the tone signal generating circuit 14 to continue generating tone signals (in the condition where the attack is not imparted), i.e., not to impart the attack to the tone signal generating circuit. Accordingly, the tone signal generating circuit 14 modifies the pitch of the digital tone signal being generated in channel No. i (="1") into the pitch corresponding to the output key data OTKD, and continues outputting the tone signals. As a result, the pitch only of the musical tone which is being produced from the sound system 17 is shifted from the pitch corresponding to the start key code $STKC_1$ toward the pitch corresponding to the destination key code $DSKC_1$ by the length of the offset key data OFKD. After the processing at step 74, the CPU 22 modifies the slur count $SCNT_1$ into "2" by adding "1" to the slur count $SCNT_1$ at step 60 and then advances the program to steps 62 and later. In this case also, the processings related to the channels Nos. 2 through 4 are executed and number of the tempo clock signals CLK is set at 3P+2 to terminate the execution of the clock interrupt program. When the clock interrupt program is executed once again with the number of the tempo clock signals CLK set at 3P+2 which is not a multiple of 3, the CPU 22 modifies the pitch of the tone signal produced in the channel No. 1 of the tone signal generating circuit 14 by the length of $OFKC_1*SCNT_1/(3*STIM_1)$ by the processings at steps 59, 61 and 71 to 74 similar to those of the case described above, advances the slur count $SCNT_1$ by the processing at step 60, repeats the above-described functions for the channels No. 2 to No. 4, advances the tempo clock signal CLK by the processings at steps 64 to 66, and terminates the execution of the clock interrupt program at step 42.

Figure 8B:
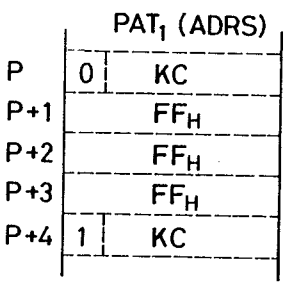
FIGS. 7B and 8B are memory maps illustrating an example of pattern data descriptive of the functions of the electronic musical instrument shown in FIG. 2.

When number of the tempo clock signals CLK becomes 3P+3, i.e., a multiple of 3 by the processings described above, the CPU 22 judges "YES" at step 46 during the execution of the clock interrupt program and sets the start key code $STKC_1$ in the pattern data $PAT_1(P+1)$ at step 47 based on the address ADRS set at P+1 (see FIG. 8B). Since the pattern data $PAT_1(P+1)$ is "FF" (hexadecimal notation) in this case, the CPU 22 advances the program to step 59 by the judgment processing at step 48 after the processing at step 47, executes the pitch modification processing for the tone signal to be produced by the tone signal generating circuit 14 and the advancing processing for the tempo clock signals CLK, and terminates the execution of the clock interrupt program. When number of the tempo clock signals CLK reaches 3P+12 in correspondence to the time $T_4$ (see FIG. 8A) during the pitch modification processing, the start key code $STKC_1$ set at step 47 has a value other than "00" (hexadecimal notation) or "FF" (hexadecimal notation) during the execution of the clock interrupt program (see FIG. 8B), and accordingly, the CPU 22 advances the program by the judgment processing at step 48 after the processing at step 47 to the search routine of the pattern data $PAT_i(j)$ consisting of steps 49 to 52 and to be processed next (except the data of "FF" (hexadecimal notation)). In this search routine, the pattern data $PAT_1(j)$ to be processed next as described above is set as an operating key code TKC. If the pattern data $PAT_1(j)$ to be processed next has no relation to the slur effect impartment in this case, the CPU judges, after the processing of the search routine, "NO", i.e., that "1" is not set at the highest bit of the operation key code TKC and sets the offset key code $OFKC_1$ at "0" at step 54. Then, the CPU 22 judges whether or not "1" is set in the highest bit of the start key code $STKC_1$ at step 55. Since the start key code $STKC_1$ corresponds to the end note of the slur effect (see FIG. 8A) and "1" is set in the highest bit MSB (see FIG. 8B), the CPU 22 judges "YES" at step 55 and advances the program to steps 75 to 77. At step 47, the key code part KC only, except the highest bit MSB, of the start key code $STKC_1$ is set as the output data OTKD by the processing similar to the masking processing at step 68. At the next step 76, the output key data OTKS is converted according to the assigned chord on the basis of the ROOT and TYPE by the processing similar to that at step 73 and, at step 77, the converted output key data OTKS is supplied to the tone signal generating circuit 14 by the processing similar to that at step 74. Accordingly, the tone signal generating circuit successively produces a digital tone signal having the pitch corresponding to the second note shown in FIG. 8A and the sound system produces a musical tone corresponding to said tone signal. After the processing at step 77, the CPU 22 controls generation of musical tone by executing the processing at steps 59 and later described above.

As is understood from the foregoing descriptions, the above-described embodiment searches the pattern data $PAT_i(j)$ corresponding to the musical tone to be produced next by the processings at steps 49 to 52 and, when the slur effect impartment to the musical tone is detected from the pattern data $PAT_i(j)$, the embodiment produces a musical tone with the slur effect whose pitch is gradually shifted in accordance with the offset key code $OFKC_1$ (key code difference $\Delta KC_1$) and the slur time $STIM_i$ by the processings at steps 68 to 70 and steps 71 to 74. As a result, it is possible for a performer to obtain the slur effect which shifts a pitch of a starting musical tone toward the pitch of the musical tone to be produced next simply by designating a chord on the keyboard as specified on a score, i.e., to realize the slur effect with no unnaturality by a simple performance technique.

Though the foregoing descriptions are given on a case where a slur sign is given between two notes, the automatic musical tone generating apparatus according to the present invention is capable of producing the slur effect in a case where the slur signs are imparted for three or more successive notes in the similar manner.

Further, though the slur data SL ("1") is stored in the pattern data $PAT_i(j)$ corresponding to the destination key code $DSKC_i$ in the embodiment described above, the slur data may be stored in the pattern data $PAT_i(j)$ corresponding to the start key code $STKC_i$. If the slur data SL in the start key code $STKC_i$ is "0" in this case, it will be unnecessary to search for the pattern data $PAT_i(j)$ for the next note.

Furthermore, though pitch is linearly shifted when the slur effect is imparted in the embodiment described above, pitch can be shifted along a predetermined curve as disclosed by Japanese Patent Laid-open No. Sho 58-211787 described as the prior art. Moreover, though the pattern data $PAT_i(j)$ for one bar is stored taking the C-major as standard and commonly for various chord in the pattern memory 23, it is possible to store pattern data longer than one bar $PAT_i(j)$, roots of chords or pattern data for various types $PAT_i(j)$ in the pattern memory 23.

In addition, though the present invention is applied to the automatic accompanying device which produces accompanying tones in accordance with chords designated on the keyboard, the present invention is applicable also to automatic performance devices which produce designated musical tones only with pitch data stored in memories and having no relation to key depression on keyboards.

What is claimed is:

1. An automatic musical tone generating apparatus for generating musical tones with slur effect comprising:

a pitch information storing means for storing pitch information for each of a plural number of musical tones to be automatically produced;

a read-out means for successively reading out at a predetermined tempo said pitch information stored in said pitch information storing means;

a tone generating means for receiving the pitch information read out by said read-out means and generating musical tones having pitches corresponding to said pitch information;

a slur information storing means for storing slur information indicating whether or not the slur effect is to be imparted to the musical tones to be produced in correspondence to the plural sets of pitch information stored in said pitch information storing means;

a slur effect impartment detecting means for detecting, on the basis of the slur information stored in said slur effect storing means whether or not the slur effect is to be imparted to the musical tones corresponding to the pitch information read out by said read-out means; and a pitch information altering means for altering, when the slur effect impartment is detected by said slur effect impartment detecting means, the pitch information read out by said read-out means to pitch information gradually approaching with time lapse to the pitch of the musical tone to be produced next and outputs the latter pitch information to said tone generating means.

2. An automatic musical tone generating apparatus for generating musical tones with slur effect according to claim 1 wherein said pitch information altering means comprises:

a search means for searching out the pitch information corresponding to a musical tone to be produced next out of the plural sets of pitch information stored in said pitch information storing means;

a pitch difference calculating means for calculating a pitch difference between the pitch information read out by said read-out means and the pitch information searched out by said search means; and an alteration control means for controlling the alteration of the pitch information read out by said read-out means at a speed in accordance with the pitch difference calculated by said pitch difference calculating means and outputting said altered pitch information.

3. An automatic musical tone generating apparatus for generating musical tones with slur effect according to claim 1 wherein said pitch information altering means comprises:

a search means for searching out pitch information corresponding to said musical tone to be produced next out of the plural sets of pitch information stored in said pitch information storing means;

a pitch difference calculating means for calculating a pitch difference between the pitch information read out by said read-out means and the pitch information searched out by said search means;

a generation interval detecting means for detecting a time interval between the generation timing of the musical tone corresponding to the pitch information read out by said read-out means and the generation timing of said musical tone to be produced next; and an alteration control means for controlling the alteration of the pitch information read out by said read-out means at a speed in accordance with the pitch difference calculated by said calculating means and the time interval detected by said generation interval detecting means, and outputting said altered pitch information.

4. An automatic musical tone generating apparatus for generating musical tones with slur effect comprising:

a pitch information storing means for storing pitch information corresponding respectively to pitches of plural musical tones to be automatically produced;

a read-out means for successively reading out at a predetermined tempo said pitch information from said storing means;

a slur information storing means for storing slur information corresponding respectively to said plural musical tones, said slur information indicating whether or not a slur effect is to be imparted to each of said plural musical tones;

a slur effect impartment detecting means for detecting whether or not a slur effect is to be imparted to each of said plural musical tones on the basis of said slur information;

a pitch information altering means for altering, if said slur effect impartment detecting means has detected that a slur effect is to be imparted to a first musical tone among said plural musical tones, the pitch information corresponding to a second musical tone among said plural musical tones to modified pitch information whose pitch approaches with time lapse to the pitch of the pitch information corresponding to said first musical tone, said first musical tone to be produced following said second musical tone;

a tone producing means for receiving said modified pitch information and producing said second musical tone in accordance with said modified pitch information.

5. An automatic musical tone generating apparatus for generating musical tones with slur effect according to claim 4 wherein said pitch information altering means comprises:

a search means for searching out the pitch information corresponding to said first and second musical tones;

a pitch difference calculating means for calculating a pitch difference between the pitches of the pitch information searched out by said search means; and an alteration control means for controlling the alteration of the pitch information corresponding to said second musical tone at a speed in accordance with said pitch difference.

6. An automatic musical tone generating apparatus for generating musical tones with slur effect according to claim 4 wherein said pitch information altering means comprises:

a search means for searching out pitch information corresponding to said first and second musical tones;

a pitch difference calculating means for calculating pitch difference between the pitches of the pitch information searched out by said search means;

a generation interval detecting means for detecting a time interval between the generation timing of said first and second musical tones; and an alteration control means for controlling the alteration of the pitch information corresponding to said second musical tone at a speed in accordance with said pitch difference and said time interval.

7. An automatic musical tone generating apparatus for generating musical tones with slur effect, comprising:

a pitch information storing means for storing pitch information for each of a plural number of musical tones to be automatically produced;

a read-out means for successively reading out, at a predetermined tempo, said pitch information stored in said pitch information storing means;

a tone generating means for receiving the pitch information read out by said read-out means and generating musical tones having pitches corresponding to said pitch information;

a slur information storing means for storing slur information indicating whether or not the slur effect is to be imparted to the musical tones to be produced in correspondence to the plural sets of pitch information stored in said pitch information storing means;

a slur effect impartment detecting means for detecting, on the basis of the slur information stored in said slur effect storing means whether or not the slur effect is to imparted to the musical tones corresponding to the pitch information read out by said read-out means; and a pitch information altering means for gradually shifting the pitch information corresponding to a first musical tone currently being produced during a first note timing to the pitch of a target musical tone to be produced during a next key-on timing, wherein the pitch information corresponding to said first musical tone is shifted during said first note timing and wherein the pitch of said target musical tone is output to said tone generating means so that said target musical tone is sounded at the start of said next key-on timing.

* * * * *